US005642721A

United States Patent [19]

Ikeya

[11] Patent Number: 5,642,721

[45] Date of Patent: Jul. 1, 1997

[54] DOUBLE IGNITION SYSTEM FOR INTERNAL COMBUSTION ENGINES, IGNITION PLUG FOR DOUBLE IGNITION SYSTEMS, AND ELECTRIC SPARK GENERATOR

[76] Inventor: Kaname Ikeya, 21-24, Nishisakado 3-chome, Sakado City, Japan

[21] Appl. No.: 544,058

[22] PCT Filed: Dec. 25, 1992

[86] PCT No.: PCT/JP92/01697

§ 371 Date: Jan. 21, 1994

§ 102(e) Date: Jan. 21, 1994

[87] PCT Pub. No.: WO93/14544

PCT Pub. Date: Jul. 22, 1993

Related U.S. Application Data

[63] Continuation of Ser. No. 190,004, Jan. 21, 1994, abandoned.

[30] Foreign Application Priority Data

Jan. 6, 1992 [JP] Japan ..... 4-046421

[51] Int. Cl.[6] ..... F02P 15/00; H01T 13/46

[52] U.S. Cl. ..... 123/627; 123/169 R; 313/124

[58] Field of Search ..... 123/627, 169 R; 313/123, 124, 603

[56] References Cited

U.S. PATENT DOCUMENTS

| | | | |
|---|---|---|---|
| 1,406,858 | 2/1922 | Henricks | 123/627 |
| 1,805,752 | 5/1931 | Birdsall | 313/124 |
| 2,467,725 | 4/1949 | Berkey et al. | 123/627 |
| 2,498,822 | 2/1950 | Palmer | 313/124 |
| 4,770,152 | 9/1988 | Mogi et al. | 123/627 |
| 4,944,280 | 7/1990 | Washington | 123/627 |
| 4,983,882 | 1/1991 | Mayring | 123/169 R |
| 5,133,328 | 7/1992 | Sato et al. | 123/627 |
| 5,142,194 | 8/1992 | Jacubeit et al. | 313/603 |
| 5,201,302 | 4/1993 | Furuya et al. | 123/627 |
| 5,402,766 | 4/1995 | Tsuchiya et al. | 123/627 |

FOREIGN PATENT DOCUMENTS

| | | | |
|---|---|---|---|
| 0378963 | 1/1989 | Germany . | |
| 0407976A1 | 7/1990 | Germany . | |
| 4204731 | 8/1992 | Germany | 123/627 |
| 2236984 | 9/1990 | Japan . | |

*Primary Examiner*—Willis R. Wolfe
*Attorney, Agent, or Firm*—Ronald R. Snider

[57] ABSTRACT

A double ignition spark plug has a cavity which is evacuated of substantially all gasses. The insulation portion of the spark plug is formed in two steps at a temperature of 800° to 1000° C. where the first sintering step is when the cavity is open and a first conductor is in place, and a second sintering step is effective to close the cavity and fix a second conductor in place. At least the second sintering step is conducted in a vacuum. The completed double ignition spark plug has substantially all gasses removed from the spark gap within the insulator.

10 Claims, 3 Drawing Sheets

DOUBLE IGNITION SYSTEM FOR INTERNAL COMBUSTION ENGINES, IGNITION PLUG FOR DOUBLE IGNITION SYSTEMS, AND ELECTRIC SPARK GENERATOR

This application is a continuation of application Ser. No. 08/190,004, filed Jan. 21, 1994, abandoned.

BACKGROUND OF THE INVENTION

1. Field of the Invention

The present invention relates to a technical field of ignition plugs for internal combustion engines using gasoline as fuel. The automobile manufacturing industry and the aircraft manufacturing industry using internal combustion engines make sincere efforts to decrease noxious substances like nitrogen oxides such as nitrogen dioxide and carbon oxides such as carbon monoxide contained in the exhaust gas emitted from engines, as efforts for developing low-pollution engines.

The present invention has been achieved to meet the demand for low-pollution engines. In the double ignition type ignition plug of the present invention, a sealed cavity is formed in the insulator outside the ignition plug, and electric arc rods are provided as parts of the feeder circuit in this cavity, to face each other with a clearance of about 10 mm kept between them. A spark is discharged in this clearance, and simultaneously, the largest possible powerful electric spark is generated at the ignition port element of the ignition plug. In this structure, electric sparks are generated simultaneously at two points by one ignition plug; inside and outside a cylinder of an engine. This system allows large electric sparks to be generated for perfect combustion of fuel gas. So, the ignition plug for double ignition systems can decrease the concentration of noxious substance in the exhaust gas by more than 60% compared to the conventional ignition plug, and can enhance the output of the engine of the same type by about 25%, for greater contribution to the traffic industry and the transport industry.

On the other hand, the electric spark generator of the present invention is used in combination with a conventional ignition plug, and since it is the same as the above double ignition type ignition plug in effect and action, it relates also to the same technical field.

2. The Prior Art

The conventional ignition plug for internal combustion engines adopts a single ignition system in which an electric spark is generated in a clearance of about 1 mm in the ignition port element of the ignition plug in a cylinder of an engine, for explosion of fuel gas. The efforts made by respective manufacturers of internal combustion engines for developing low-pollution engines have been centered on the improvement of the engine itself such as the CVCC (compound vortex controlled combustion) engine with a sub combustion chamber in addition to a main combustion chamber, and the catalytic methods for decreasing noxious substances in the exhaust gas. The CVCC engine is not used any more since the burning of lean mixture lowers the engine output, hence, lowers the driving performance and quality which the tomobiles are expected to achieve. On the other hand, the catalytic methods cannot be said to be perfect due to many problems such as the dissolution of the catalyst caused by imperfect combustion of fuel gas, even though the catalytic methods are mainly pursued for the development of low-pollution engines. In addition, the improvement of the engine itself and the adoption of any catalytic method require large costs. In this situation, little efforts have been made for the improvement of the ignition plug itself which has been made in the present invention.

SUMMARY OF THE INVENTION

This double ignition type spark plug has a cylindrical cavity enclosed as shown by symbol A in FIG. 2 which is within the portion or insulating outside of the ignition plug. The electric arc rods of nichrome wires, tungsten, or brass, are installed with a clearance of 5–15 millimeters (about 10 millimeters ideally) in the cavity. The cavity has a 7 mm diameter and 15 length. The spark is discharged at the gap within the cavity, and the discharge causes the charge to be collected in the conductor wire extending from the cavity to the ignition port element of the ignition plug. This increases the current at the ignition port element of the ignition plug and causes a large and powerful spark to be generated simultaneously in a structure. This generates electric sparks simultaneously at two points inside and outside of the automobile cylinder, i.e. sparks are generated in the cavity and at the ignition port element. The spark is sharp and short in duration, and the noise generated by the discharge spark in the enclosed cavity does not escape or leak to the outside. In this manner the engine remains or is kept silent.

During construction, the insulator outside of the plug is sintered in two steps at optimum temperatures of 800°–1000° C. The sintering of the first step is effective to form the cavity (partially) which cavity is left open, and the sintering step fixes the conductor extending therefrom into the ignition port element. The second sintering step closes the cavity and provides for insulation of the electric rods in the cavity and fixing of the conductor extending therefrom to a connection terminal of the spark plug.

The present invention provides a new ignition plug which has never been considered, i.e., a double ignition type ignition plug which allows electric sparks to be generated simultaneously at two points inside and outside a cylinder of an engine, and the electric spark generated at the ignition port element of the ignition plug is so large and powerful as to achieve perfect combustion of fuel gas, for improving the combustion rate and halving the concentration of noxious substances in the exhaust gas, thereby enhancing the engine output. This can be said to be the least costly economical engine improvement method which can achieve a low-pollution engine simply by improving the ignition plug.

On the other hand, the electric spark generator of the present invention is used in combination with a conventional ignition plug (single ignition type), and this combination achieves the same double ignition effect as described for the above double ignition type ignition plug unprecedentedly.

The nitrogen oxides such as nitrogen dioxide, carbon oxides such as carbon monoxide, etc. contained in the exhaust gas emitted from the internal combustion engines of automobiles, etc. seriously affect human health especially in recent years. The people are highly concerned about global environmental pollution, and the industries concerned are seriously grappling with the prevention of environmental pollution.

The technical problem to be solved by the invention is to lower the concentration of the above mentioned noxious substances in the exhaust gases emitted from internal combustion engines as part of the efforts to develop low-pollution engines useful for the prevention of air pollution. It is also intended to improve the output performance relative to the engine capacity.

The problem can be easily solved by improving the combustion rate of the fuel gas in the internal combustion engines by achieving more perfect combustion of fuel gas. The more perfect combustion of fuel gas can be achieved by generating larger and more powerful electric sparks at the ignition port element of the ignition plug in a cylinder of an engine, and this is surmised to be the best solution of the problem. Under this concept, the double ignition system and the double ignition type ignition plug of the present invention have been completed.

The double ignition type ignition plug can generate incomparably larger and more powerful electric sparks at the ignition port element of the ignition plug than those generated by the conventional single ignition type ignition plug, and allows the fuel gas in a cylinder of an engine to be burned almost perfectly, for lowering the concentration of said noxious substances in the exhaust gas by more than about 60%. In addition, the improved combustion rate raises the output of the engine of the same type by about 25% very effectively for improvement of engine performance.

For the double ignition type ignition plug, a cylindrical cavity (of vacuum ideally) enclosed in the porcelain or insulator outside the ignition plug is formed, and in the cavity (7 mm in diameter and 15 mm in length), electric arc rods of nichrome wires, tungsten or brass are installed to face each other with a clearance of 5 mm to 15 mm (about 10 mm ideally) as parts of the feeder circuit, so that a spark may be discharged at the clearance. The spark discharged in the cavity causes many charges to be collected in the conductor extending from there to the ignition port clement of the ignition plug, and at the ignition port clement of the ignition plug, a grown current discharges a large and powerful spark simultaneously. The electric spark generated at the ignition port clement of the ignition plug caused by the spark discharged in the cavity is sharp and short in duration. Furthermore, since the spark is discharged in the enclosed cavity, the noise due to the spark discharge does not leak outside, to keep the engine silent.

The clearance at the ignition port element of the ignition plug is somewhat wider than that in the conventional single ignition type ignition plug, i.e., 1.1 mm to 5 mm (about 1.8 mm as an optimum clearance) for generating a larger electric spark.

The sintering for the outer insulator of the double ignition type ignition plug is effected in two steps; the sintering for forming the cavity followed by the sintering for sealing the cavity. The insulator sintering temperature is about 800° to 1,000° C.

On the other hand, the electric spark generator of the present invention is to be connected with the connection terminal 3 of a conventional single ignition type ignition plug. As shown in FIG. 3A, a cylindrical cavity (of vacuum ideally) enclosed in a porcelain or insulator cylinder is formed, and electric arc rods of brass are installed to face each other through a clearance of 5 mm to 15 mm (about 10 mm ideally) as parts of the feeder circuit in the cavity (7 mm in diameter and 15 mm in length).

If an electric spark is generated at the clearance, it causes many charges to be collected in the conductor extending from there to an ignition port element of the ignition plug. As a result, the current increased at the ignition port element of the ignition plug generates a large electric spark. The electric spark generator combined with a conventional ignition plug forms a double ignition system which generates two electric sparks simultaneously, and the effect achieved by the electric spark generator is quite the same as achieved by the double ignition type ignition plug. The electrodes at both the ends of the electric spark generator are made of brass, and are connected with an ignition plug by a socket and plug to allow disconnection, considering the life of the ignition plug.

An advantage of the present invention over the prior art is that the double ignition type ignition plug can lower the concentration of the noxious substances in the exhaust gas emitted from engines by more than about 60% compared to the conventional single ignition type ignition plug. This effect allow the engines to simply conform to the Muskie Law in U.S.A. While the decrease of the above mentioned noxious substances by any improved engine (CVCC engine, etc.) or any catalytic method is very costly, the present invention is very economical since the intended effect can be achieved simply by improving the ignition plug. In addition, it can enhance the combustion rate, for raising the engine output by about 25%.

On the other hand, the electric spark generator of the present invention can be used in combination with a conventional single ignition type ignition plug, to form a double ignition system, and since it also acts similarly, its effect is quite the same as that of the double ignition type ignition plug. This configuration is unprecedented.

BRIEF DESCRIPTION OF THE DRAWINGS

1. Sealed Cavity to be generated Electric Sparks by Electric Arc Rods
2. Ignition port Clearance
3. Connection Terminal

1. Sealed Cylindrical Cavity
2. Ignition Port Clearance
3. Feeder Connection Terminal
4.5. Brass Central Electric Axis
6.7. Nichrome, Tungsten, orBrass Electric Arc Rod
8. Clearance
9. Porcelain or Insulator Isorate Material
11. Metal Cace
12. Iron Screw Fit to Engine
13. Eeath Element
15. Ignition Port Element

1. Sealed Cylindrical Cavity
2. Connection Socket
3. Feeder Connection Terminal
4.5. Brass Electrode
6.7. Brass Electric Arc Rod
8. Clearance
9. Porcelain or Insulator Cylindrical Isorate Material
10. Anti Heat Rubber

1. Ignition Port Element
2. Ignition Port Clearance
3. Connection Terminal

DETAILED DESCRIPTION

The present invention is described below in more detail in reference to the attached drawings.

Figure 1A:
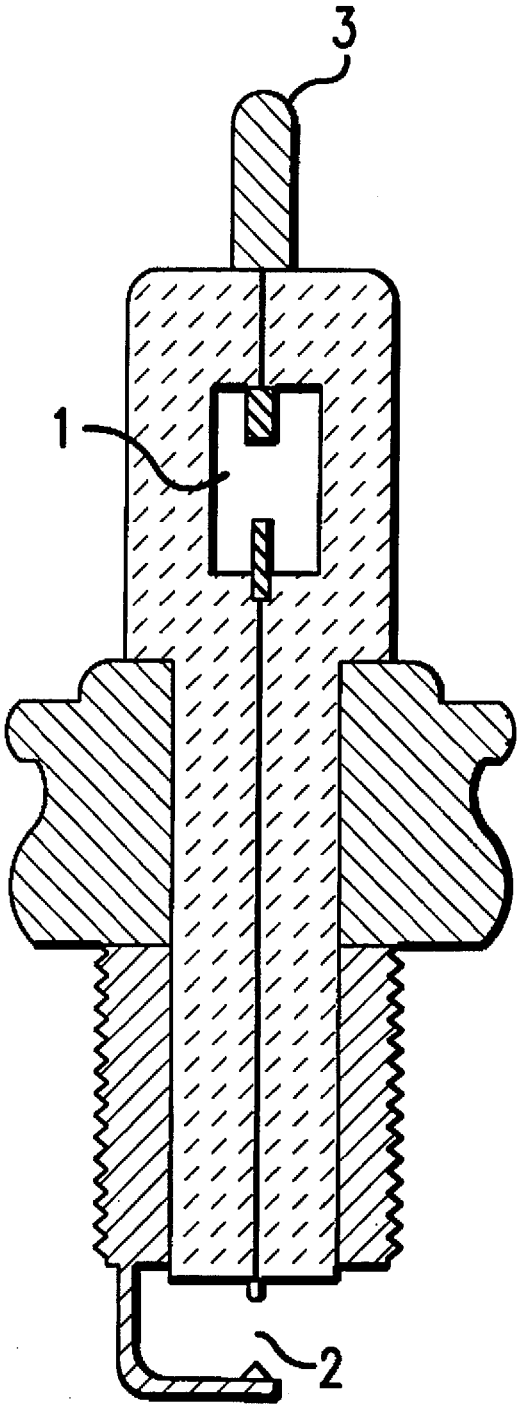
FIG. 1A is a sectional view showing the double ignition type ignition plug of the present invention, based on which the idea of the present invention could be created.

The description for FIG. 1A is not made here.

Figure 2A:
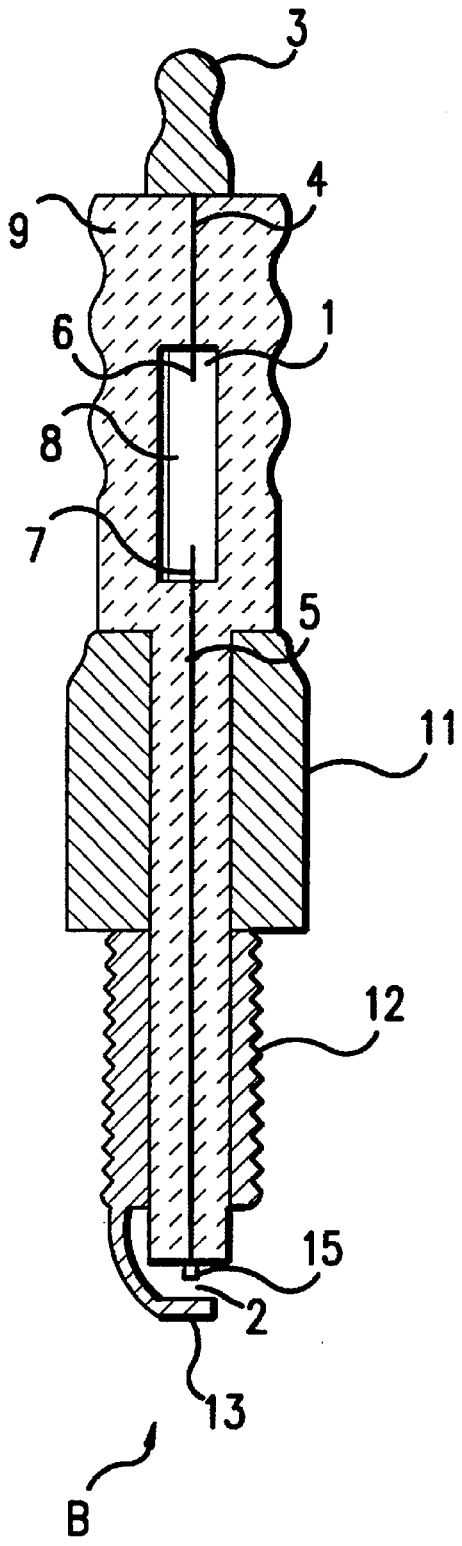
FIG. 2A is a preferable sectional view showing the double ignition type ignition plug of the present invention in detail.

FIG. 2A is a sectional view showing the double ignition type ignition plug in detail. The discharge of a spark at the clearance 8 between the arc rods 6.7. facing each other in the cylindrical cavity 1 enclosed in the insulator isorate material 9 indicated in this drawing is a major idea of the present invention. A spark is discharged at this clearance 8, and simultaneously a powerful and large spark is generated at the ignition port element 15 (or at the ignition port clearance 2) of the ignition plug. At two points of one ignition plug, sparks are generated simultaneously. This is the double ignition of the present invention.

As shown by this drawing, in the cylindrical sealed cavity 1 (of vacuum ideally) of 7 mm in diameter and 15 mm in length enclosed in the insulator isorate material 9 outside the ignition plug, the arc rods 6.7. of tungsten or brass are installed to face each other with a clearance 8 of about 10 mm as parts of the feeder circuit, and a spark is discharged at the clearance 8. The clearance 8 between the arc rods 6.7. can be adjusted to generate the largest possible electric spark. If a spark is once discharged in the cavity 1, a sharp, large and powerful electric spark is generated at the ignition port element 15 of the ignition plug.

The clearance 2 of the ignition port element 15 of the ignition plug shown by this drawing is adjusted to be somewhat wider than that of the conventional ignition plug, i.e., about 1.8 mm, since the charges are increased by the action of double ignition, to increase the current.

The numeral number 3 in this drawing denotes the connection terminal of the ignition plug to the feeder.

The outer insulator portion of the ignition plug is sintered in two steps. The optimum sintering temperature is about 800° to 1,000° C. The sintering of the first step is effected to form an open cavity 1 in the insurator isorate material 9. The sintering of the second step to enclose the cavity 1 is effected to install the arc rods 6.7. in the cavity 1 and to fix the two central electric axes 4.5. extending from there to the connection terminal 3 and on other hand, to the ignition port element 15.

The double ignition type ignition plug can be used to lower the concentration of noxious substances in the exhaust gas emitted from the engine by more than about 60% and enhance the engine output by about 25%.

Figure 3A:
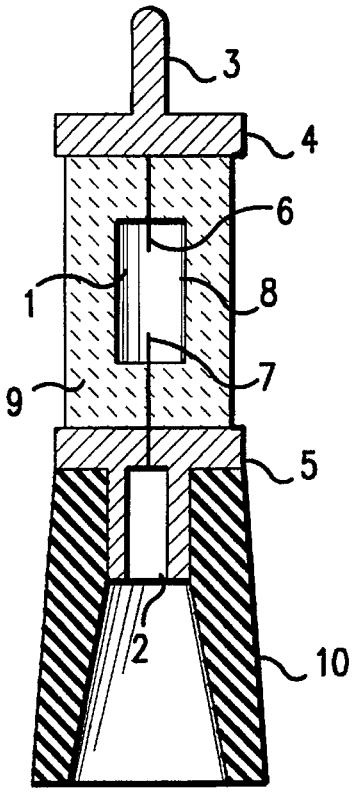
FIG. 3A is a sectional view showing the electric spark generator of the present invention, to be combined with a conventional single ignition type ignition plug, for forming a double ignition system.

The electric spark generator shown in FIG. 3A is described below.

Figure 4A:
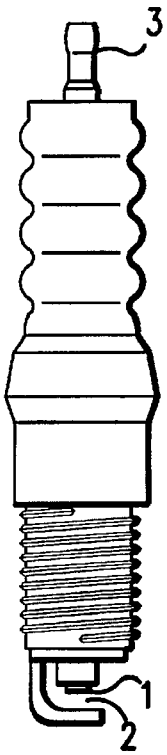
FIG. 4A is a sectional view showing a conventional single ignition type ignition plug.

The electric spark generator is connected to the connection terminal 3 of the conventional single ignition type ignition plug shown in FIG. 4A, for use as a double ignition system. As shown in FIG. 3A, the cylindrical cavity (1) (of vacuum ideally) enclosed in the cylindrical insulator (9) is formed, and the arc rods (6.7,) of brass are installed to face each other with a clearance(8) of about 10 mm as parts of the feeder circuit in the cavity (1)(7 mm in diameter and 15 mm in length), to discharge a spark at the clearance (8). The clearance (8) should also be desirably adjusted to generate the largest possible electric spark.

The electrodes (4 and 5) at both the ends of the electric spark generator are also made of brass, and are connected with the ignition plug by a socket (2), to allow easy disconnection from the connection terminal of the ignition plug, considering the life of the ignition plug. The socket is protected by resistant rubber (10). The numeral number 3 in this drawing denotes the connection terminal to the feeder. And as all parts ( brass electrodes (4.5.), cylindrical insulator isorate material (9), anti heat rubber (10)) of the electric spark generator adopt method of screw, so that, is very easy to be fit together. [Industrial Applicability]

The double ignition system, double ignition type ignition plug and electric spark generator of the present invention can be used in the automobile manufacturing industry and the aircraft manufacturing industry which are making efforts to lower the concentration of noxious substances like nitrogen oxides such as nitrogen dioxide, carbon oxides such as carbon monoxide, etc. contained in the exhaust gas emitted from internal combustion engines by improving the engines and adopting new catalytic methods.

I claim:

1. A double ignition spark plug constructed by a process comprising the steps of:

making an iron base;

forming an insulator extending through said iron base;

forming an ignition spark gap at said iron base by extending a first conductor through said insulator and extending towards a portion of said iron base;

forming a cavity in said insulator;

extending said first conductor into said cavity;

extending a second conductor into said cavity and forming a space between said first and second conductors within said cavity;

evacuating said cavity of substantially all gases;

providing a connecting terminal on said insulator;

and connecting said second conductor to said conducting terminal.

2. The method in accordance with claim 1 further comprising the step of sintering said insulator in two steps at temperatures of 800°–1000° C., wherein said first step is when the cavity is left open and the first conductor is in place, and wherein said second sintering step is effective to close said cavity and to fix said second conductor in place.

3. The method in accordance with claim 1 further comprising the step of making the clearance between said first conductor portion extending towards said iron to be 1.1–5.0 millimeters.

4. The method in accordance with claim 1 further comprising of forming one of said first and second conductors of a material selected from the group consisting of nichrome, tungsten, and brass.

5. The method in accordance with claim 1 further comprising the step of forming said cavity to have a 7 millimeter diameter and a 15 millimeter length.

6. The method in accordance with claim 2 further comprising the step of making the clearance between said first conductor portion extending towards said iron to be 1.1–5.0 millimeters.

7. The method in accordance with claim 2 further comprising of forming one of said first and second conductors of a material selected from the group consisting of nichrome, tungsten, and brass.

8. The method in accordance with claim 2 further comprising the step of forming said cavity to have a 7 millimeter diameter and a 15 millimeter length.

9. The method in accordance with claim 3 further comprising of forming one of said first and second conductors of a material selected from the group consisting of nichrome, tungsten, and brass.

10. The method in accordance with claim 4 further comprising the step of forming said cavity to have a 7 millimeter diameter and a 15 millimeter length.

* * * * *